US006000273A

United States Patent [19]

Stover

[11] Patent Number: 6,000,273

[45] Date of Patent: Dec. 14, 1999

[54] PRESS BRAKE PUNCH HOLDER

[76] Inventor: Carl Stover, 222 Stover Dr., Delaware, Ohio 43015

[21] Appl. No.: 09/176,434

[22] Filed: Oct. 21, 1998

[51] Int. Cl.[6] ..... B21D 37/04; B21D 11/22

[52] U.S. Cl. ..... 72/482.3; 72/481.1; 72/462; 72/482.2

[58] Field of Search ..... 72/389.5, 448, 72/482.2, 482.3, 481.1, 462

[56] References Cited

U.S. PATENT DOCUMENTS

| | | | |
|---|---|---|---|
| 4,142,398 | 3/1979 | Quaas | 72/482.2 |
| 4,354,374 | 10/1982 | Deguchi . | |
| 4,653,307 | 3/1987 | Zbornik | 72/389.4 |
| 4,733,552 | 3/1988 | Leflis . | |
| 4,787,237 | 11/1988 | Houston et al. . | |
| 4,895,014 | 1/1990 | Houston . | |
| 5,009,098 | 4/1991 | van Merksteijn . | |
| 5,022,256 | 6/1991 | van der Meulen . | |
| 5,065,610 | 11/1991 | Yonezawa . | |
| 5,113,686 | 5/1992 | Kawahara . | |
| 5,121,626 | 6/1992 | Baldwin . | |
| 5,390,527 | 2/1995 | Kawano . | |
| 5,460,027 | 10/1995 | Takahashi . | |
| 5,507,170 | 4/1996 | Kawano . | |
| 5,511,407 | 4/1996 | Kawano . | |
| 5,513,514 | 5/1996 | Kawano . | |
| 5,572,902 | 11/1996 | Kawano . | |
| 5,619,885 | 4/1997 | Kawano et al. . | |
| 5,642,642 | 7/1997 | Kawano . | |
| 5,685,191 | 11/1997 | Kawano et al. . | |
| 5,794,486 | 8/1998 | Sugimoto et al. . | |
| 5,884,522 | 3/1999 | Runk et al. | 72/482.2 |

FOREIGN PATENT DOCUMENTS

| | | | |
|---|---|---|---|
| 616783 | 8/1935 | Germany . | |
| 62-267019 | 11/1987 | Japan | 72/482.2 |
| 1382543 | 3/1988 | U.S.S.R. | 72/482.3 |

*Primary Examiner*—David Jones
*Attorney, Agent, or Firm*—Richard C. Litman

[57] ABSTRACT

The press brake punch holder has a main housing adapted for attachment to the ram of a press brake. A pair of mating wedge strips are disposed within the housing, the lower wedge strip being slidable with respect to the upper wedge strip. A U-shaped channel is disposed between two flanges depending from the side walls of the main housing, the exterior surfaces of the flanges being beveled, the U-shaped channel being slidable vertically between the flanges. A bolt extends through each upper wedge, a slot defined in each mating lower wedge, and a slot defined in the bottom of the housing, in order to thread into holes defined in the U-shaped channel. A support member having a cross shape in cross section depends from the U-shaped channel. A plurality of clamps are bolted into the ends of the side arms of the support member, the clamps being spring biased to clamp the shank of a punch between the clamp and the lower leg of the support member. The upper edge of the clamp is beveled to mate with the beveled edges of the flanges. The lower wedge strip may be pulled along its longitudinal axis, either by mechanical, electrical or hydraulic power, the bolts pulling the U-shaped channel vertically upward, causing the upper edge of the clamps to slide up the side of the flanges, thereby opening the clamps simultaneously and releasing the punch.

7 Claims, 6 Drawing Sheets

PRESS BRAKE PUNCH HOLDER

BACKGROUND OF THE INVENTION

1. Field of the Invention

The present invention relates to machine shop apparatus for shaping and forming sheet metal, and more particularly to a holder for the punch of a press brake.

2. Description of the Related Art

Most sheet metal machine shops are commonly equipped with a press brake for shaping and forming sheet metal. The press braise is used to form flanges and other bends and shapes in long or thin strips of sheet metal. The device generally includes a frame which has a long apron supporting a press table or bed on which is mounted a female die or molding. Vertically above the press table is another apron, often referred to as a ram, on which is mounted a male die or punch. Although in some presses the lower apron, or both aprons, are moveable, more commonly the ram is slidably moved in the vertical direction with great force against the stationary press table in order to compress the work piece between the punch and the female die, thereby bending and shaping the sheet metal according to the particular punch and die combination. The ram may be operated by a pair of hydraulic cylinder and piston assemblies at either end of the ram, or by a mechanical crankshaft. Usually the apparatus will include a flywheel to maintain sufficient energy to operate the ram, the flywheel maintaining the energy level at idle when the ram is not in use.

The ram and the press table are often quite long, press brakes between seven feet and twenty feet not being uncommon. The punch and the die are removable and replaceable assemblies, there being different designs of punches to impart different shapes to the metal. The punch may be one long continuous piece, or the punch may be shorter, discrete pieces attached end to end along the length of the ram. Various problems may result from this construction.

For precision work, it is desirable to form bends or shapes which are uniform in depth throughout the length of the work piece. Since the pistons exert the greatest force at the ends of the ram, over a period of time the ram or die may develop a curvature towards the center due to constant wear, or other irregularities my develop on the surface of the punch or the press table.. Consequently, it is desirable to provide some means for adjusting the depth or curvature of the punch. Further, the punch must be clamped to the ram, the clamps usually being secured by bolts. It has been found that better clamping action is obtained by using a plurality of clamps along the length of the ram than a single long clamp. With a plurality of discrete clamps attached along the length of the ram, it is inconvenient, time consuming, and inefficient to have to unbolt and bolt each clamp individually when replacing the punch. A central mechanism for controlling and releasing the clamps quickly is therefore desirable.

A variety of devices have been developed for addressing these problems. U.S. Pat. No. 4,354,374, issued Oct. 19, 1982 to H. Deguchi, teaches a punch mounted on a slide and a die mounted on a press table, where pairs of wedges are installed under the table, the top wedge being attached to the table and the bottom wedge being slidable. The bottom has a rack engaged by a pinion operable from the front of the table, such that as the rack is adjusted, the wedges raise and lower the height of the table in order to control the depth of the cut. U.S. Pat. No. 4,733,552, issued Mar. 29, 1988 to M. Leflis, shows a press with relocatable dies at fixed work stations for performing multiple shaping operations on strip fed sheet metal.

U.S. Pat. No. 4,787,237, issued Nov. 29, 1988 to Houston, et al., describes clamps for holding the punch and the die, the clamps having a fixed member and an L-shaped member slidable on a bolt connecting the fixed and slidable members. A pneumatically or hydraulically operated cylinder and piston are mounted concentrically with the bolt adjacent the fixed member, a spring biasing the piston to extend from the cylinder against the fixed member to pull the slidable member to a clamping position, the application of air or hydraulic pressure causing the piston to retract so that the slidable member relaxes to an open position. U.S. Pat. No. 4,895,014, issued Jan. 23, 1990 to D. L. Houston, shows an improvement in the foregoing clamp system having segmented clamps with one embodiment in which the clamp is released mechanically by rotating a cammed handle which moves a row of wedges longitudinally down the length of the ram or press table, moving the clamps laterally to a release position overcoming the bias of the springs, and a second embodiment in which pneumatic or hydraulic pressure forces a piston against an elongated clamp contact member which moves the individual clamp segments.

U.S. Pat. No. 5,009,098, issued Apr. 23, 1991 to J. L. Merksteijn, describes a press having curve forming means to compensate for sagging in the bends produced in the work piece resulting from wear or irregularities in the punch or die, consisting of strips with members moveable longitudinally and transversely with each other, which shim the table, being angled more in the center than at the ends, and being moveable longitudinally by a hand crank or electrical or hydraulic means. U.S. Pat. No. 5,022,256, issued Jun. 11, 1991 to J. van der Meulen, shows a clamping device having a fixed jaw and a pivoting jaw with a resilient strip between the two, the resilient strip having a wedge which interlocks with the punch tool. A hydraulic cylinder pushes a piston against the pivoting jaw to clamp the tool.

U.S. Pat. No. 5,065,610, issued Nov. 19, 1991 to K. Yonezawa, teaches a clamp having a front jaw and a back jaw, the front jaw being separated into separate plates longitudinally, the clamp being spring biased to normally hold the clamp. The clamp is released by hydraulic pressure, each plate having a cylinder and piston, the pistons extending to push the jaw away from the punch, the cylinders being connected by a continuous hydraulic line with pipes between the individual plates. U.S. Pat. No. 5,113,686, issued May 19, 1992 to T. Kawahara, shows a pin for precisely locating the die on a "bolster". The pin is placed in registered recesses in the die and the bolster and has resilient collars which expand when the collar is pressed in the die.

U.S. Pat. No. 5,121,626, issued Jun. 16, 1992 to J. B. Baldwin, shows a means for clamping a die to the ram or the bed which has an adjustment means to counteract wear on the die. The device includes a support bracket with an angled lower surface, a thrust member having a wedge shape under the bracket's lower surface, and a disk rotatably mounted on the bracket which engages a slot on the thrust member in order to move the thrust member laterally to raise and lower the die. U.S. Pat. No. 5,460,027, issued Oct. 24, 1995 to Y. Takahashi, shows a clamp for attaching punches with a uniformly planar shank or punches with a longitudinal groove in the shank for engaging a projection on the clamp. The clamp is attached to the ram by bolts and has a lower projection for engaging a groove on the shank, the projection being pivotal and spring biased against the shank of the punch.

A series of patents have been issued to S. Kawano, including U.S. Pat. Nos. 5,390,527, issued Feb. 21, 1995; 5,507,170, issued Apr. 16, 1996; 5,511,407, issued Apr. 30, 1996; 5,513,514, issued May 7, 1996; 5,572,902, issued Nov. 12, 1996; 5,619,885, issued Apr. 15, 1997; 5,642,642, issued Jul. 1, 1997; and 5,685,191, issued Nov. 11, 1997. U.S. Pat. No. 5,794,486, issued Aug. 18, 1998 to Sugimoto, et al., describes another variation on the Kawano devices.

The Kawano patents show a clamp mounted on a holder operated by a lever rotating between stops, the punch being held between the clamp and the holder, a wedge between the holder and the ram, the clamp being resiliently biased against the holder. Variations include a triangular wedge between the clamp and the punch, the wedge having a projection engaging a groove on the shank of the punch, the triangular wedge being spring biased, hydraulic cylinders to release the clamp, mating projections on the clamp and punch to prevent the punch from accidentally falling, an adjustable clamp piece mounted on the clamp pushing against a spring or elastic member, an elastic clamp, etc.

German Patent No. 616,783, published Aug. 5, 1935, describes an adjustment mechanism mounted on the ram for counteracting curvature of the ram or the bed, which includes a lower wedge strip extending the length of the ram, and a pair of upper wedge strips divided at the center of the ram, the slope of the wedges diminishing from the center of the rams to the ends, the curvature of the punch being adjusted by attaching the ends of the wedge strips to adjustment screw spindles at the ends of the ram, the screws pulling the upper wedge strip over the lower wedge strip to form a gap in the center, the angles of the wedges increasing the depth of the punch towards the center of the ram.

The present invention deals only with the problem of alleviating the time and inconvenience involved in unbolting a plurality of clamps to release the punch. It does not purport to address the problem of wear and irregularities in the punch or die.

The three newest clamp holding devices available include the Wilson Express Clamp, made by Wilson Tool International, the Amada One Touch (see the Kawano patents cited above), and a system made by MachineFabrik Wila. The Wilson and Amada devices employ a rotary handle to release each clamp. While this represents an advance over past systems which required unbolting two bolts per clamp with perhaps thirty to forty clamps over a ten foot length of ram, nevertheless it still leaves the problem of operating thirty to forty rotary handles over a ten foot length of ram. The Wila device employs a hydraulic bladder type apparatus to release the clamps. The problem with this device is that the hydraulic system is complicated, expensive, and may develop a leak, rendering the system inoperable. Further, since the hydraulic lines are continuous, the Wila system precludes the flexibility of selectively removing individual punches normally permitted in manual systems.

Therefore, there is a need for a mechanical device which will open a plurality of clamps simultaneously to release to release the punch. None of the above inventions and patents, taken either singularly or in combination, is seen to describe the instant invention as claimed. Thus a press brake punch holder solving the aforementioned problems is desired.

SUMMARY OF THE INVENTION

The press brake punch holder has a main housing adapted for attachment to the ram of a press brake. A pair of mating wedge strips are disposed within the housing, the lower wedge strip being slidable with respect to the upper wedge strip. A U-shaped channel is disposed between two flanges depending from the side walls of the main housing, the exterior surfaces of the flanges being beveled, the U-shaped channel being slidable vertically between the flanges. A bolt extends through each upper wedge, a slot defined in each mating lower wedge, and a slot defined in the bottom of the housing, in order to thread into holes defined in the U-shaped channel. A support member having a cross shape in cross section depends from the U-shaped channel. A plurality of clamps are bolted into the ends of the side arms of the support member, the clamps being spring biased to clamp the shank of a punch between the clamp and the lower leg of the support member. The upper edge of the clamp is beveled to mate with the beveled edges of the flanges. The lower wedge strip may be pulled along its longitudinal axis, either by mechanical, electrical or hydraulic power, the bolts pulling the U-shaped channel vertically upward, causing the upper edge of the clamps to slide up the side of the flanges, thereby opening the clamps simultaneously and releasing the punch.

Accordingly, it is a principal object of the invention to provide a punch holder for a press brake which opens a plurality of clamps aligned end to end along the length of the ram simultaneously by simple mechanical devices in order to release the punch.

It is another object of the invention to provide a punch holder for a press brake which opens a plurality of clamps along the length of the ram simultaneously in which the release mechanism is enclosed within a main housing to protect the moving parts from dust, dirt, oils, damage from mechanical impact, and bending forces from the downward movement of the ram.

It is a further object of the invention to provide a press brake punch holder which opens a plurality of clamps simultaneously in order to release the punch or punches in which individual punches may be inserted vertically and removed selectively to provide for different bending patterns and shapes.

Still another object of the invention is to provide a punch holder for a press brake which is reliable, economical, and mechanically actuated to provide for low maintenance and reduced shutdown time for removal and replacement of punches.

It is an object of the invention to provide improved elements and arrangements thereof for the purposes described which is inexpensive, dependable and fully effective in accomplishing its intended purposes.

These and other objects of the present invention will become readily apparent upon further review of the following specification and drawings.

BRIEF DESCRIPTION OF THE DRAWINGS

Similar reference characters denote corresponding features consistently throughout the attached drawings.

DETAILED DESCRIPTION OF THE PREFERRED EMBODIMENTS

Figure 1:
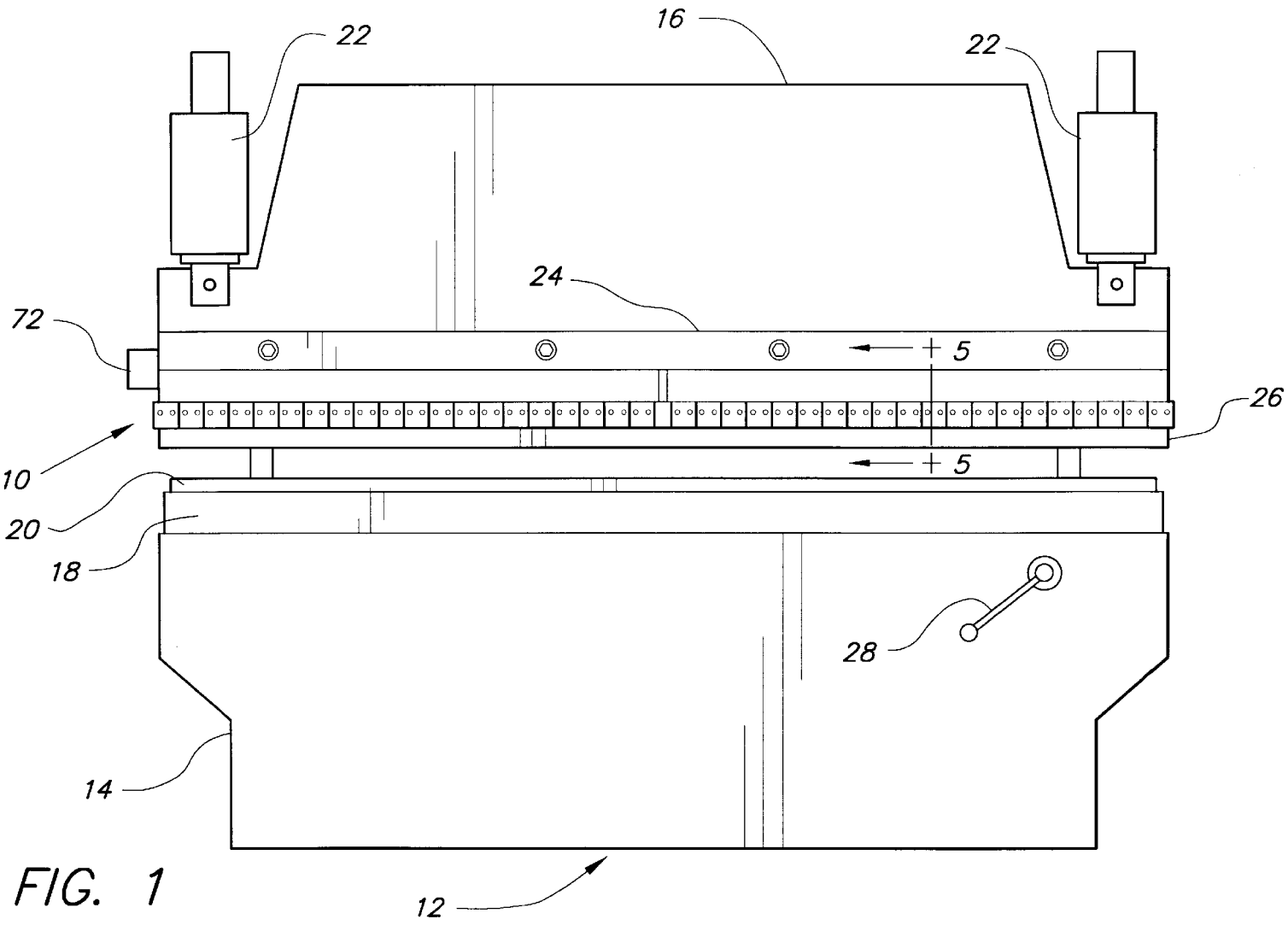
FIG. 1 is an environmental, front view of a press brake with a press brake punch holder according to the present invention in place.

The present invention is a press brake punch holder, designated generally as 10 in the drawings. FIG. 1 shows a typical press brake 12 for bending and shaping sheet metal. The press brake 12 includes a fixed apron 14 and a reciprocating ram 16. The apron 14 has a bed 18 or press table on which a female die 20 is clamped. The ram 16 is slidably moved in the vertical direction with the aid of a pair of hydraulic cylinders 22 on either side of the ram 16. Along its bottom edge the ram 16 has a spreader bar and clamp assembly 24 which secures the punch holder 10 to the ram 16. Clamped in the punch holder 10 is a punch 26 which coacts with the female die 20 to bend the metal into the desired shape. The brake 12 may include a crank handle 28 for operating a back gage, a foot pedal (not shown) for operating the ram 16, and a stroke gage (not shown) for setting the depth of the bend.

Figure 2:
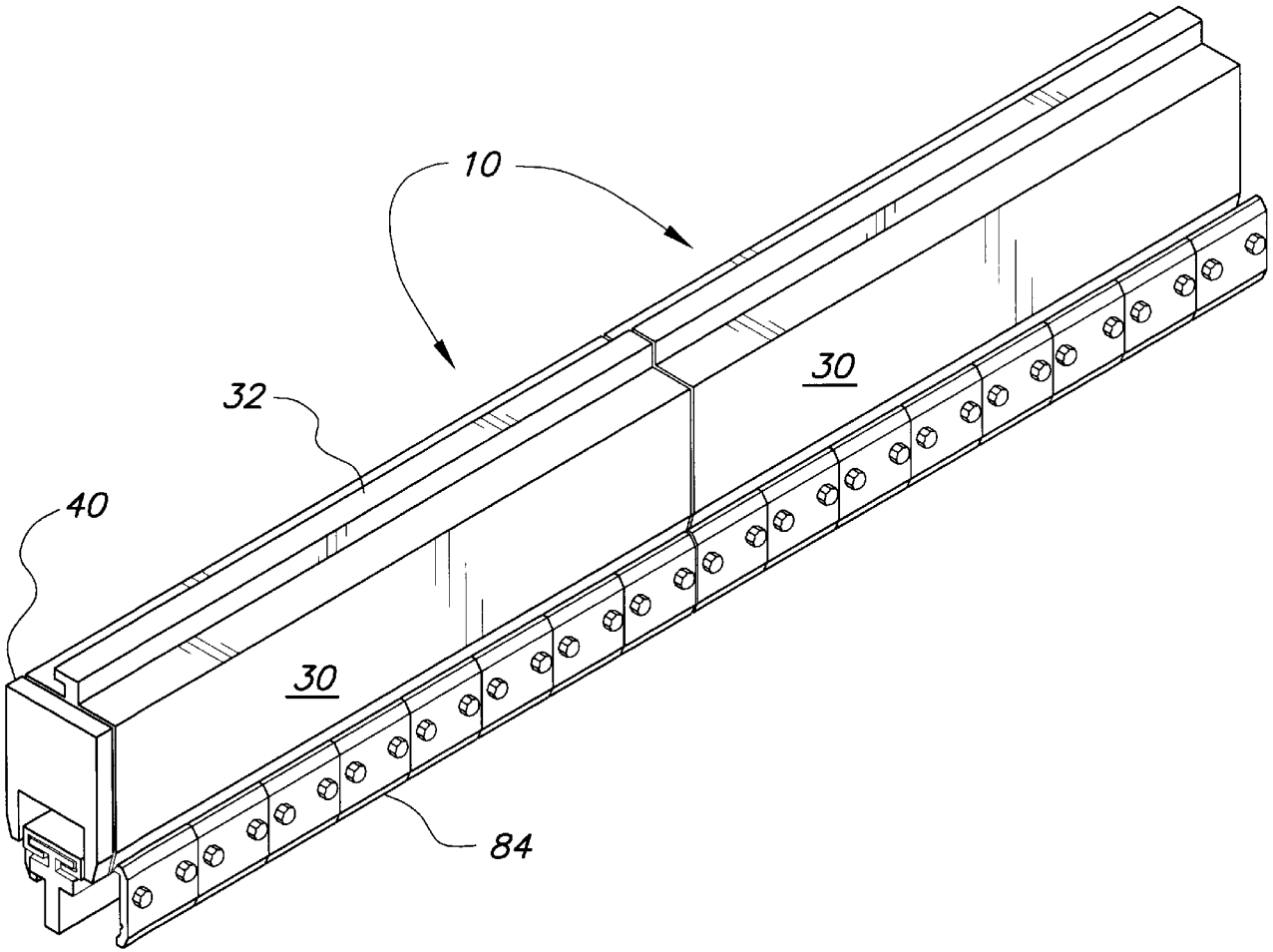
FIG. 2 is a perspective view of a press brake punch holder according to the present invention.

In more detail, FIG. 2 shows two punch holders 10 aligned end to end. It is a feature of the present invention that two or more punch holders 10 may be operably connected to adjust for the length of the ram 16. Press brakes 12 may vary in length from about seven feet to about twenty feet. The modular construction of the punch holder 10 is designed to permit concatenating units to accommodate the different sizes of machines. The punch holder 12 itself may be made in lengths of about one meter or two meters, although it may also be made as one continuous unit spanning the length of the ram 16. The punch holder 10 includes a main housing 30 and a removable end cap 40 at both ends of the main housing, and supports two parallel rows of clamps 84 on either side of the main housing 30. The main housing 30 includes a mounting shank 32 disposed on the outer surface of its top wall 34. Press brakes 12 normally include a tang, a spreader bar, and clamp assembly 24 on the nose of the ram 16 for attaching a tool holder or punch holder 10 to the ram 16, the assembly 24 being of a standard or conventional design used on most commercially available brakes 12. The mounting shank 32 is adapted for clamping by the assembly 24 on the nose of the ram 16.

Figure 3:
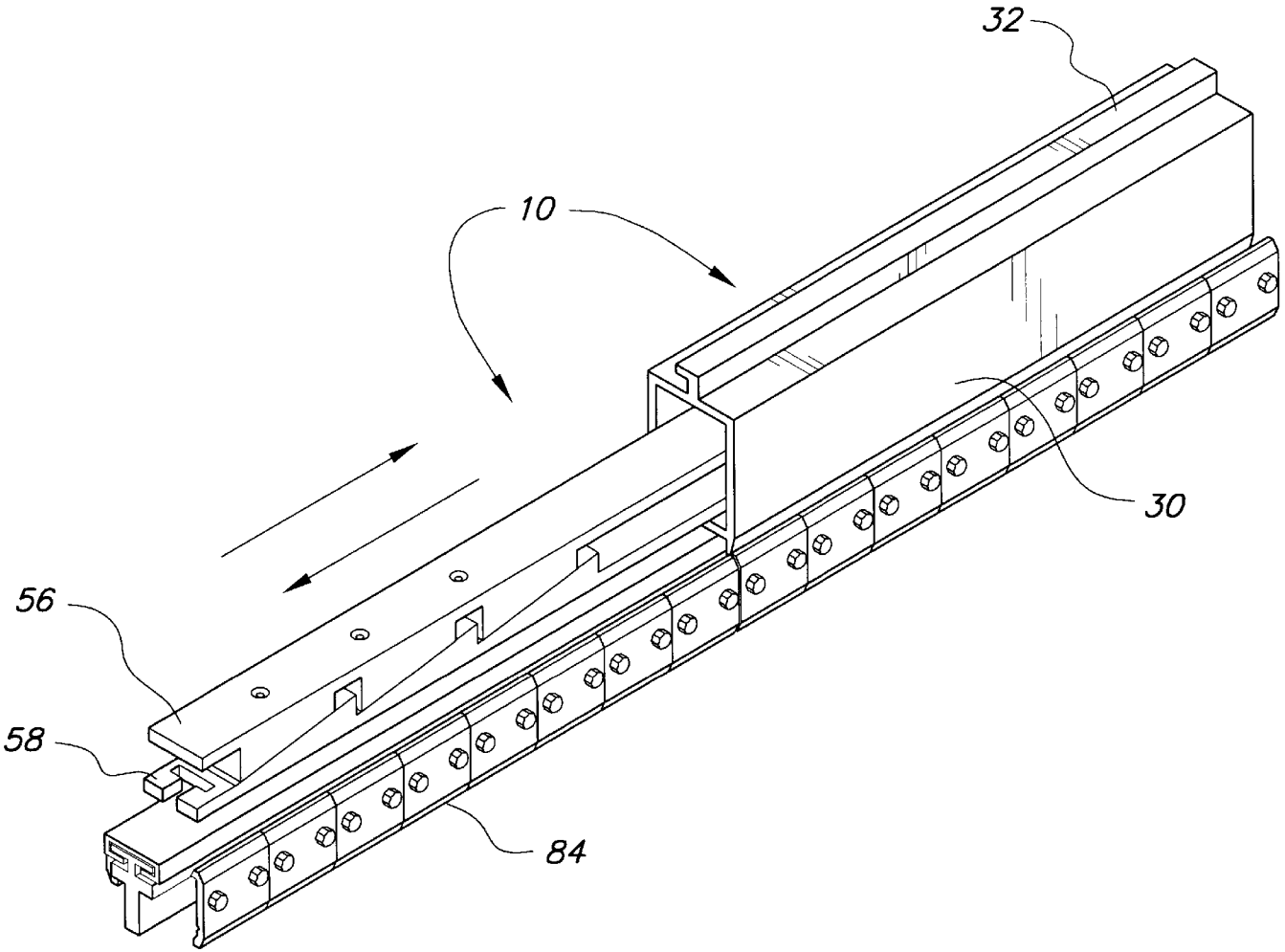
FIG. 3 is a perspective view of the press brake punch holder with the main housing broken away to show the wedge strips.
Figure 4:
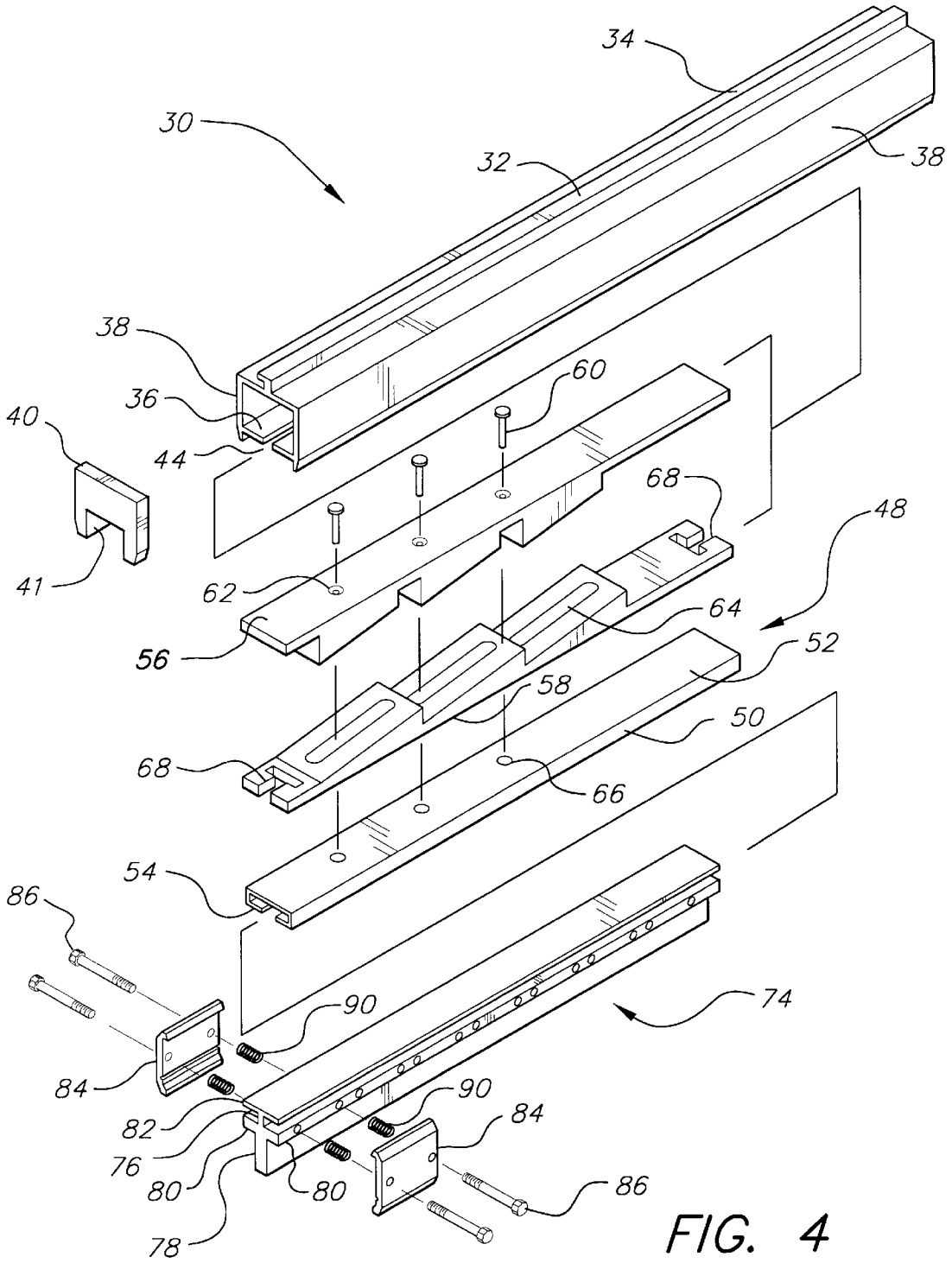
FIG. 4 is an exploded view of the press brake punch holder according to the present invention.
Figure 5:
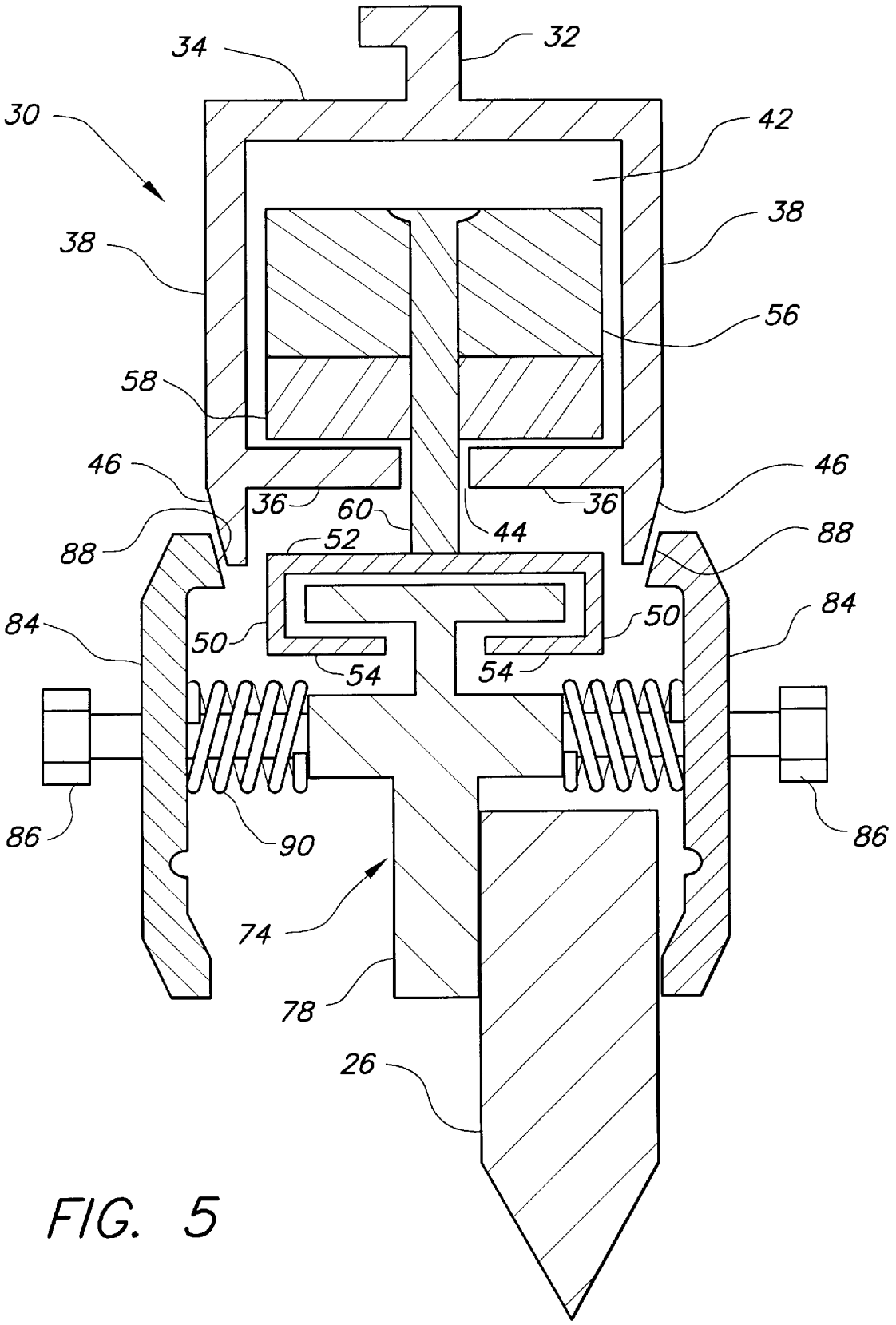
FIG. 5 is a sectional view of the press brake punch holder along the line 5—5 of FIG. 1.

As shown more particularly in FIGS. 3, 4, and 5, the main housing is a hollow tube having a rectangular shape in cross section, having a top wall 34, a bottom wall 36, and two opposing lateral walls 38 defining a cavity 42 which is rectangular in cross section and extends the length of the housing 30. The bottom wall 36 has a slot 44 defined therein extending longitudinally. A pair of flanges 46 depend from the lateral walls 38 of the housing 30 and extend the length of the housing 30, the exterior surface of the flanges 46 being beveled.

A U-shaped channel 48 is disposed between the flanges 46, the channel 48 being inverted so that its side walls 50 depend vertically from its base 52, the channel 48 being slidable vertically between the flanges 46. A pair of projections 54 extend from the ends of the side walls 50 towards the interior of the channel. An upper wedge strip 56 and a lower wedge strip 58 are disposed within the cavity 42 defined in the housing 30, the upper wedge strip 56 being disposed with the wedge surfaces facing vertically downwards and the lower wedge strip 58 being disposed with the wedge surfaces facing vertically upwards. The wedge strips 56,58 have a plurality of triangular shaped wedges defined therein, the slope of the wedges on the upper 56 and lower 58 strips being supplementary so that normally the surfaces of the wedges on the upper strip 56 fully engage the surfaces of the lower strips 58. The punch holder 10 includes a plurality of bolts or wedge pins 60, each wedge pin 60 extending through a hole 62 defined in an upper wedge, a slot 64 defined in a lower wedge, the slot 44 defined in the bottom wall 36, and threads into a hole 66 defined in the U-shaped channel 48.

Figure 6:
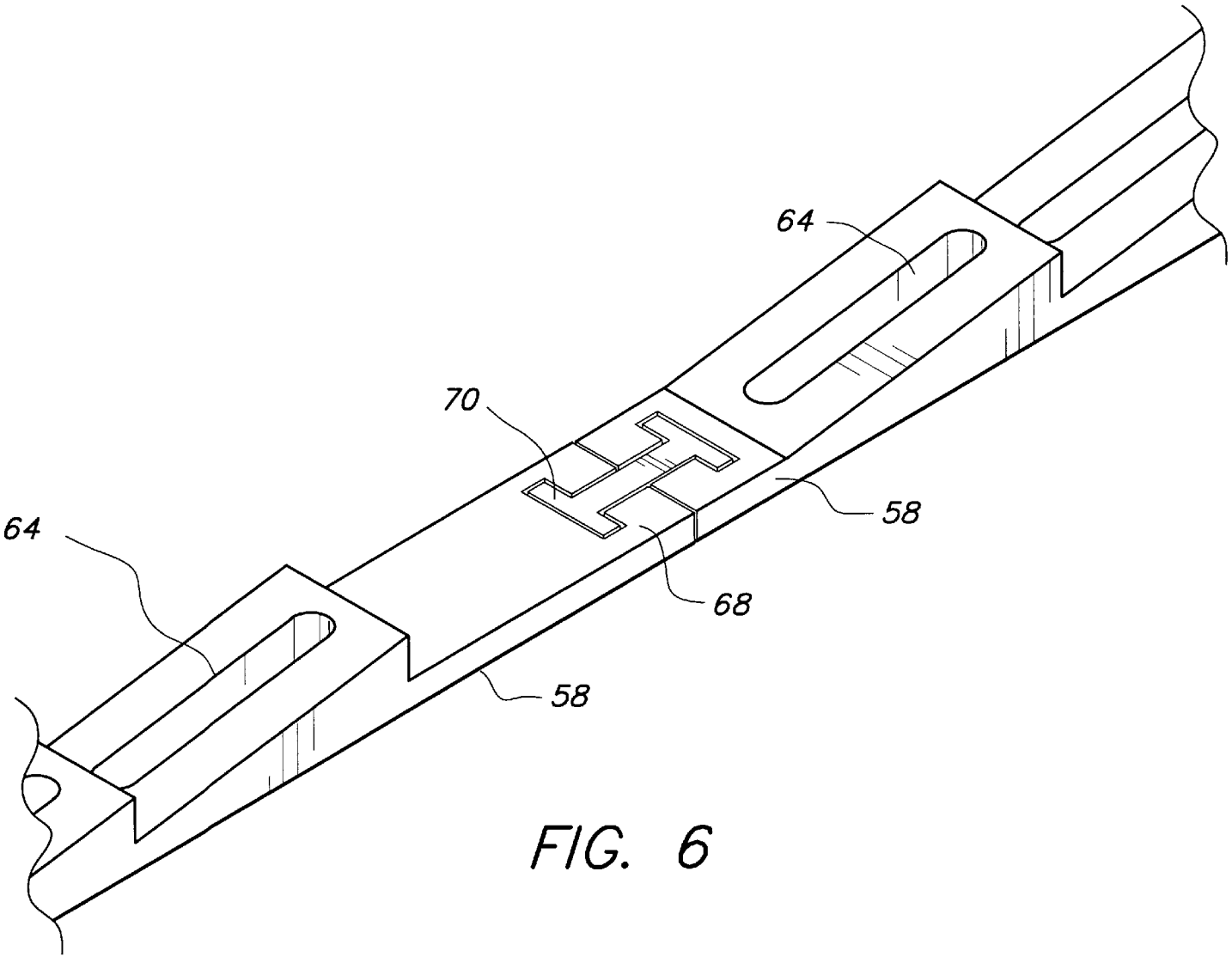
FIG. 6 is a fragmented view of two abutting lower wedge strips showing the method of connecting the strips in order to concatenate press brake punch holder units according to the present invention.

The lower wedge strip 58 has a connector arms at both ends of the strip 68. The lower wedge strip 58 of one punch holder 10 unit may be connected to the end of a second lower wedge strip 58 in a second punch holder 10 by means of an I-shaped link 70, as shown in FIG. 6, which snaps into the connector arms 68 of adjacent lower wedge strips 58, the end caps 40 on abutting housing 30 units being removed. This construction permits punch holder 10 units to be concatenated to adapt to the length of the ram 16, and provides easy retrofitting of the punch holder 10 to existing press brakes 12.

A series of lower wedge strips 58 is connected to an operator controlled pulling means 72 at one end of the ram 16 by the connector 68. The end cap 40 on the end punch holder 10 unit has a cutout 41 defined therein such that the end cap 40 retains the upper wedge strips 56 in fixed position, while permitting the lower wedge strip 58 to be pulled from the housing 30 along the longitudinal axis of the ram 16, the extent of travel being limited by the length of the slots 64 defined in the wedges of the lower wedge strips 58. The pulling means 72 may be mechanical, electrical, or hydraulic, of any type known to those skilled in the art having sufficient power to pull and push the lower wedge strip 58, including a ratchet, a winch, an electric motor with suitable gearing, a hydraulic cylinder and piston, etc. When not in use, the pulling means 72 may be removed and the end cap 40 re-attached to protect the mechanism.

As the lower wedge strip 58 is pulled longitudinally from the housing 30, the upper wedge strip 56 is raised by coaction of the wedges, the bolts 60 sliding in the slots 64 and raising the U-shaped channel 48 vertically between the flanges 46. One end of each wedge strip 56, 58 is free of wedges so that when the lower wedge is pulled, the lead wedge on the lower wedge strip 58 of a second punch holder unit 10 attached to the first has room to slide under the upper wedge strip 56 of the first punch holder unit 10.

The punch holder 10 includes a cross shaped support member 74 having a top leg 76, a bottom leg 78, and a pair of side arms 80. The top leg 76 has a top flange 82 giving the top leg 76 a T-shape appearance, the top flange 82 or cross bar of the T being disposed within the U-shaped channel 48 and supported by the projections 54, the top leg 76 extending between the projections 54 so that the support member 74 depends from the channel 48. A plurality of clamps 84 are attached to both sides of the support member 74, each clamp 84 being attached by a pair of bolts 86 threaded into the lateral surface of the side arms 80, the clamp 84 being slidable on the shafts of the bolts 86 between a clamping position to retain the punch 26, and a release position for removing the punch 26. Each clamp 84 has a beveled edge 88 on its upper, inner surface supplementary to the beveled edge on the exterior surface of the flange 46. Each clamp 84 is resiliently biased against the support member 74 by helical springs 90 disposed around the shafts of the bolts 86 between the body of the clamp 84 and the side arm 80 in order to normally grip the shank of a punch 26 between the clamp 84 and the bottom leg 78 of the support member 74.

In operation, a punch 26 may be inserted between the clamp 84 and the bottom leg 78 of the support member 74 by one of two methods. For a long punch spanning several clamp members 84, the lower wedge strip 58 may be pulled by activating the pulling means 72 in order to simultaneously open all of the clamps 84, the upper wedge strips 56 being raised and consequently raising the channel 48 and support member 74 to wedge the flanges 46 against the clamps 84, pushing the clamps 84 outwardly against the tension of the springs 90. The punch 26 may then be inserted by sliding the shank of the punch 26 between the clamp 84 and the bottom leg 78 from the end of the holder 10, or raising the punch 26 vertically from below the holder 10 to insert the shank of the punch 26, whereupon the pulling means 72 may be reversed to push the lower wedge strip 58 back in to its normal position below the upper wedge strip 56, the springs 90 biasing the clamps to a clamping position to grip the punch 26. Alternatively, the clamps 84 may be pulled away from the support member 74 against the tension of the springs 90 and the shank of the punch 26 may be inserted by lifting the punch up vertically from below the holder 10, a particularly useful feature for short punches 26. Removal of the punch 26 is the reverse of the above procedure.

It will be understood that the punch 26 may be inserted in either the inside or outside row of clamps 84 depending upon the pattern of the punch 26, or to create a reverse pattern bend. It will further be understood that the punch holder may be used either with American style punches 26 (with the bending edge in the same plane as the shank of the punch 26), or with European style punches (not shown) (with the shank in plane offset from the bending edge).

The press brake punch holder 10 is made from heat treated steel, with the U-shaped channel 48 being made from spring steel.

It is to be understood that the present invention is not limited to the embodiments described above, but encompasses any and all embodiments within the scope of the following claims.

I claim:

1. A press brake punch holder for attaching at least one punch die to a nose of a reciprocating ram of a press brake, comprising:

a) a main housing, the housing being a hollow tube having a first end and a second end, and having a rectangular cross section defined by a top wall, a bottom wall, and two opposing lateral walls connecting the top wall with the bottom wall and defining a cavity, the cavity being rectangular in cross section, the top wall having ram attachment means for attachment to the ram of a press brake, the bottom wall having a slot extending longitudinally defined therein, the housing having removable end caps at the first and second ends;

b) a pair of flanges depending from the lateral walls of said main housing and extending the length of said main housing, the flanges having an exterior surface, the exterior surface having a beveled edge;

c) a support member having a top leg, a bottom leg, and a pair of side arms, the side arms having a free end, the top leg having a flange, the support member depending from said housing;

d) a plurality of clamps attached to the ends of the side arms of said support member, the clamps having a beveled edge supplementary to and engaging the exterior surface of said flanges, the clamps being disposed on both sides of said support member, the clamps being slidable between a clamping position and a release position, the clamps having biasing means for resiliently biasing said clamps in order to normally retain a shank of at least one punch die; and e) clamp release means for raising said support member in order to wedge said flanges between said support member and said plurality of clamps, whereby said plurality of clamps slide to the release position simultaneously in order to release the shank of said at least one punch die.

2. The press brake punch holder according to claim 1, wherein said biasing means comprises a plurality of springs disposed between said support member and said plurality of clamps.

3. The press brake punch holder according to claim 1, wherein said clamp release means comprises:

a) a U-shaped channel having a base and opposing side walls, the channel being disposed between said pair of flanges and being inverted so that the side walls depend vertically from the base, the channel being slidable vertically between said pair of flanges, the side walls having projections extending into the channel, and the base having a plurality of threaded holes defined therein, said support member depending from the channel, the flange of the top leg of said support member being supported by the projections;

b) an upper wedge strip and a lower wedge strip, the wedge strips each having a plurality of wedges defined therein, said upper and lower wedge strips being disposed within the cavity of said main housing, the wedges defined in said upper wedge strip having surfaces facing vertically downwards in order to engage said lower wedge strip in slidable contact, the wedges defined in said lower wedge strips having surfaces facing vertically upwards, the slope of the wedges being supplementary so that normally the wedge surfaces of said upper wedge strip fully engage the wedge surfaces of said lower wedge strip;

c) a plurality of wedge pins, each wedge pin extending through a hole defined in a wedge of said upper wedge strip, through a slot defined in a wedge of said lower wedge strip, through the slot defined in the bottom wall of said housing, and being threadably secured in one of said holes defined in the base of said U-shaped channel; and d) pulling means for pulling said lower wedge strip, the end caps having a cutout defined therein such that said upper wedge strip is held fixed in position and said lower wedge strip is slidable through the cutout in said end cap, the travel of the lower wedge strip being limited by the length of the slots defined in the wedges of said lower wedge strip, in order to raise said upper wedge strip, and thereby raising said plurality of clamps simultaneously to the release position for releasing the shank of said at least one punch die.

4. The press brake punch holder according to claim 3, wherein said lower wedge strip further comprises a first end and a second end, the first end and the second end having connector arms, the press brake punch holder further comprising an I-shaped link whereby an end of the lower wedge strip of a first press brake punch holder is adapted for detachably connecting to an end of the lower wedge strip of a second press brake punch holder by snapping the I-shaped link into the connector arms of abutting lower wedge strips of said first and second press brake punch holders, in order to operably connect a plurality of press brake punch holders end to end.

5. The press brake punch holder according to claim 3, wherein said pulling means is powered mechanically.

6. The press brake punch holder according to claim 3, wherein said pulling means is powered electrically.

7. The press brake punch holder according to claim 3, wherein said pulling means is powered hydraulically.

* * * * *

UNITED STATES PATENT AND TRADEMARK OFFICE

CERTIFICATE OF CORRECTION

PATENT NO. : 6,000,273
DATED : December 14, 1999
INVENTOR(S) : Carl Stover

It is certified that error appears in the above-identified patent and that said Letters Patent is hereby corrected as shown below:

Title page,
Line 23, after heading "ABSTRACT" "opening" should read -- closing --, and "releasing" should read -- securing --.

Column 4,
Line 17, "opening" should read -- closing --, and "releasing" should read -- securing --.

Column 5,
Line 28, "12" should read -- 10 --.

Column 6,
Line 63, "pulled" should read -- pushed --.
Line 65, "the" should read -- The --.
Line 66, "raised" should read -- lowered -- and "raising" should read -- lowering --.
Line 67, "wedge" should read -- release --, and "against" should read -- from contact with --.

Column 7,
Lines 4 and 5, "holder 10" should read -- support member 74 --.
Lines 14-15, "is the reverse of the above procedure" should read -- may be achieved by either depressing the top of the clamps 84, which then pivot about the bolt 86 to release the punch 26 for vertical removal, or by sliding a longer puch 26 out from the end of support member 74 --.

Column 8,
Line 46, "release" should read -- clamping --.
Line 47, "releasing" should read -- clamping --.

Signed and Sealed this

Sixteenth Day of April, 2002

*Attest:*

*Attesting Officer*

JAMES E. ROGAN
*Director of the United States Patent and Trademark Office*